US007125267B1

(12) United States Patent
Yeh

(10) Patent No.: US 7,125,267 B1
(45) Date of Patent: Oct. 24, 2006

(54) EXTENDABLE USB MALE PLUG

(76) Inventor: Ming-Hsiang Yeh, 14F, No. 375, Nan-Gang District, Fu De Street, Taipei City (TW)

( * ) Notice: Subject to any disclaimer, the term of this patent is extended or adjusted under 35 U.S.C. 154(b) by 0 days.

(21) Appl. No.: 11/377,375

(22) Filed: Mar. 17, 2006

Related U.S. Application Data

(62) Division of application No. 11/171,341, filed on Jul. 1, 2005, now Pat. No. 7,037,120.

(51) Int. Cl.
*H01R 13/44* (2006.01)
*H01R 29/00* (2006.01)

(52) U.S. Cl. ..... 439/131; 439/173

(58) Field of Classification Search ..... 439/131, 439/171, 172, 173, 76.1, 945
See application file for complete search history.

(56) References Cited

U.S. PATENT DOCUMENTS

| | | | | |
|---|---|---|---|---|
| 6,475,003 | B1 * | 11/2002 | Jones et al. | 439/131 |
| 6,490,163 | B1 * | 12/2002 | Pua et al. | 361/737 |
| 6,676,419 | B1 * | 1/2004 | Lin et al. | 439/76.1 |
| 6,676,420 | B1 * | 1/2004 | Liu et al. | 439/131 |
| 6,808,400 | B1 * | 10/2004 | Tu | 439/131 |
| 2005/0130471 | A1 * | 6/2005 | Regen et al. | 439/131 |

* cited by examiner

*Primary Examiner*—Hien Vu
(74) *Attorney, Agent, or Firm*—Troxell Law Office, PLLC

(57) ABSTRACT

An extendable USB male plug is disclosed. The extendable USB male plug comprises a button for controlling the terminal block. The terminal block is outwardly extendable by pressing and shifting the button so the length of the USB male plug is elongated. Thus, it facilitates the insertion of the USB male plug and also solves excessively deep position, crowding, and insufficient space problems of the USB female socket on the computer.

4 Claims, 10 Drawing Sheets

EXTENDABLE USB MALE PLUG

RELATED APPLICATIONS

This application is a Division of application U.S. Ser. No. 11/171,341, entitled "EXTENDABLE USB MALE PLUG" and filed on Jul. 1, 2005 now U.S. Pat. No. 7,037,120.

FIELD OF THE INVENTION

The present invention is related to an extendable USB male plug capable of changing the length. The extendable USB male plug is suitable for all kinds of wires, connectors, conversion connectors, conversion wires, connectors of related apparatuses, or the likes.

BACKGROUND OF THE INVENTION

It is commonly seen that many computers and peripheral apparatuses, such as scanners, digital cameras, removable hard disks, etc, introduce the Universal Serial Bus (USB) specification into the connection interface of a transmission connector. The USB connector can unify various specifications for various connectors so as to overcome the conventional shortcoming of providing a specific connector for a specific apparatus.

A computer is generally equipped with two USB female sockets. Moreover, the existing peripheral apparatus of the computer is mainly equipped with the USB male plug. In response to this, the new generation computer is always equipped with several USB female sockets for insertion of the USB male plugs on the peripheral apparatuses.

Nevertheless, for the purpose of not changing the dimension of the computer or reducing the occupied space of the computer, such as the barebone system, the positions and depths of the USB female sockets formed in various computers are different from one another. Accordingly, the following problems are caused, in which:

1. If the USB female sockets are mounted excessively deep, the USB male plug cannot be inserted into the USB female socket even through they are provided complying with the specification.

2. If the number of the USB female socket is increased, a USB male plug cannot be inserted into a USB female socket when another excessively close female socket, is occupied by another USB male plug.

In view of the shortcoming in the conventional structure, an extendable USB male plug for overcoming excessively deep position and insufficient space problems of the USB female socket is provided in accordance with the motive of the present invention.

SUMMARY OF THE INVENTION

It is a main object of the present invention to provide an extendable USB male plug capable of changing the position of the terminal block.

It is another object of the present invention to provide an extendable USB male plug capable of changing the angle of the terminal block.

It is a further object of the present invention to provide an extendable USB male plug capable of enhancing the connection stability.

In order to achieve the aforementioned object, an extendable USB male plug is disclosed. The extendable USB male plug comprises a button for controlling the terminal block. The terminal block is outwardly extendable by pressing and shifting the button so the length of the USB male plug is elongated. Thus, it facilitates the insertion of the USB male plug and also solves excessively deep position, crowding, and insufficient space problems of the USB female socket on the computer.

The aforementioned aspects and advantages of the present invention will be readily clarified in the description of the preferred embodiments and the enclosed drawings of the present invention.

DETAILED DESCRIPTION OF THE PREFERRED EMBODIMENT

Figure 1:
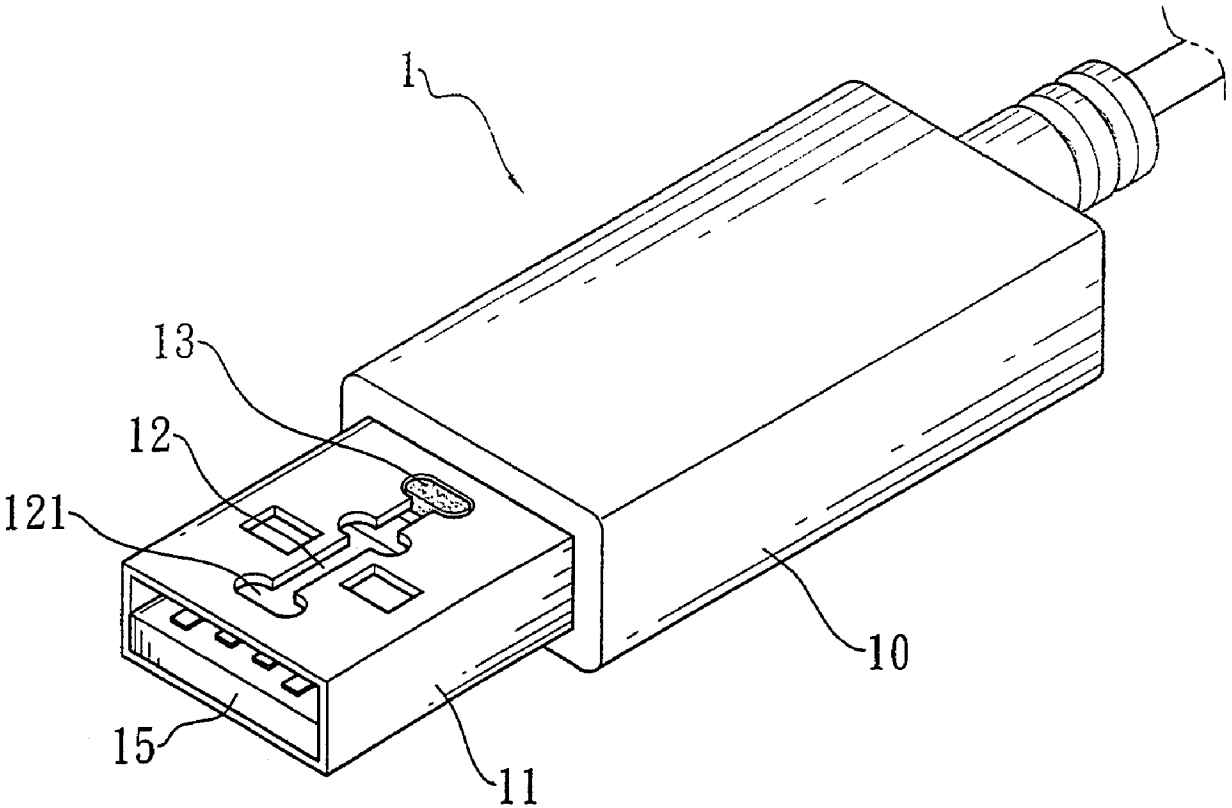
FIG. 1 is an elevational view showing the first preferred embodiment of the present invention.
Figure 2:
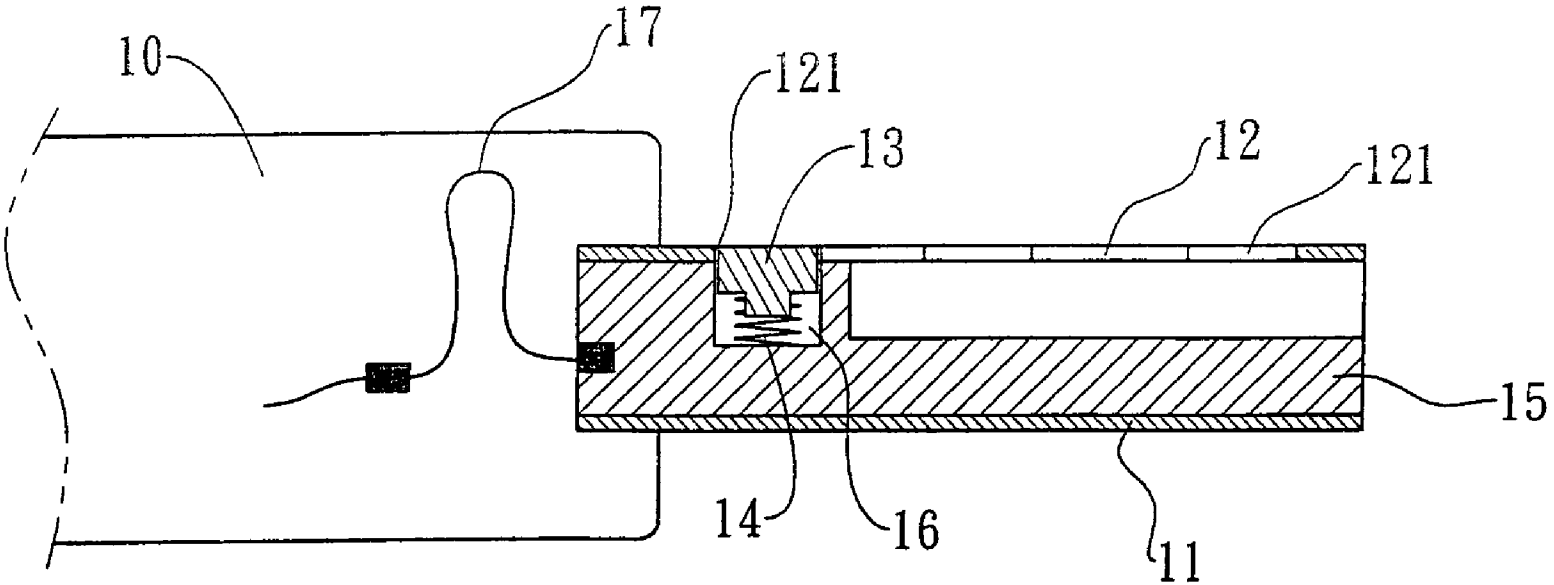
FIG. 2 is a cross-sectional view showing the first preferred embodiment of the present invention.

Referring to FIG. 1 and FIG. 2, a USB male plug 1 of the present invention comprises a terminal block 15, an insulating frame 11, and a plastic housing 10, wherein a track 12 is formed on the insulating frame 11. Besides, an outwardly expanded limit frame 121 is formed on the front, middle, and back sections of the track 12. A trench 16 is formed on the back of the terminal block 15, wherein a spring 14 is mounted in the trench 16. When assembled, the terminal block 15 is inserted into the insulating frame 11 to exactly align the trench 16 of the terminal block 15 with the limit frame 121 on the track 12. In addition, a button 13 having a shape corresponding to the outline of the limit frame 121 is inserted into the limit frame 121 and the trench 16 for being coupled with the spring 14. Consequently, the button 13 is positioned in the trench 16 and its surface is at the same height as the track 12 so as to form a hidden button. If the rear end of the insulating frame 11 is coupled to the plastic housing 10, the terminal block 15 is connected to a conducting wire, which is mounted on its backside, through a longer connection wire 17.

Figure 3:
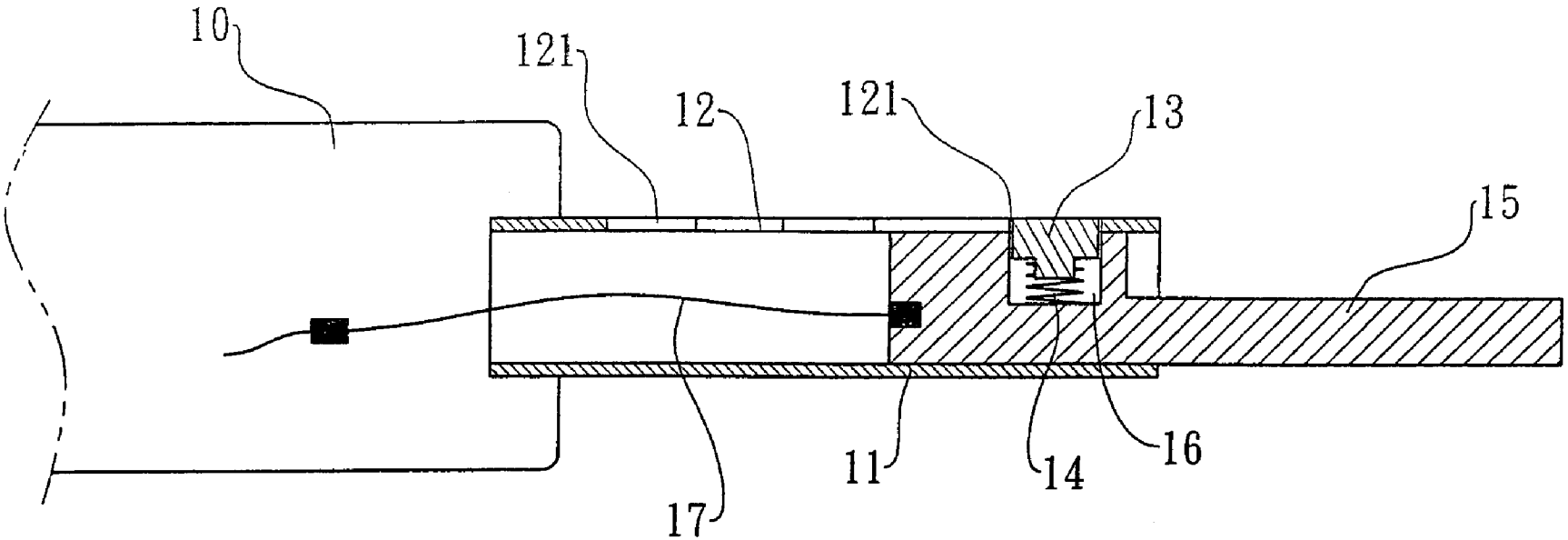
FIG. 3 is a cross-sectional view showing the usage of the first preferred embodiment of the present invention.

Referring to FIG. 3, by pressing, the hidden button 13 of the USB male plug 1 of the present invention can be further moved away from the limit frame 121 into the trench 16. As a result, the button 13 can be pushed forward along, the track 12 so as to extend the terminal block 15 out of the insulating frame 11. Consequently, the USB male plug 1 is extendable.

Figure 4:
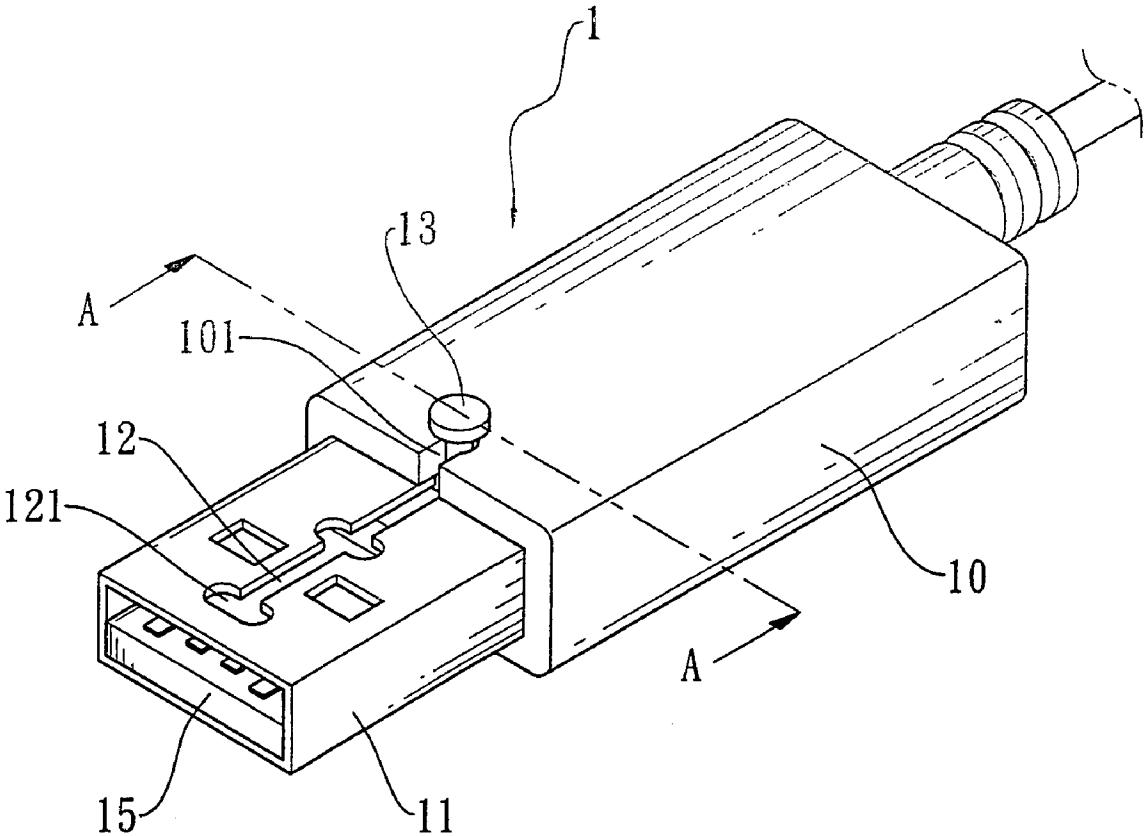
FIG. 4 is an elevational view showing the second preferred embodiment of the present invention.
Figure 5:
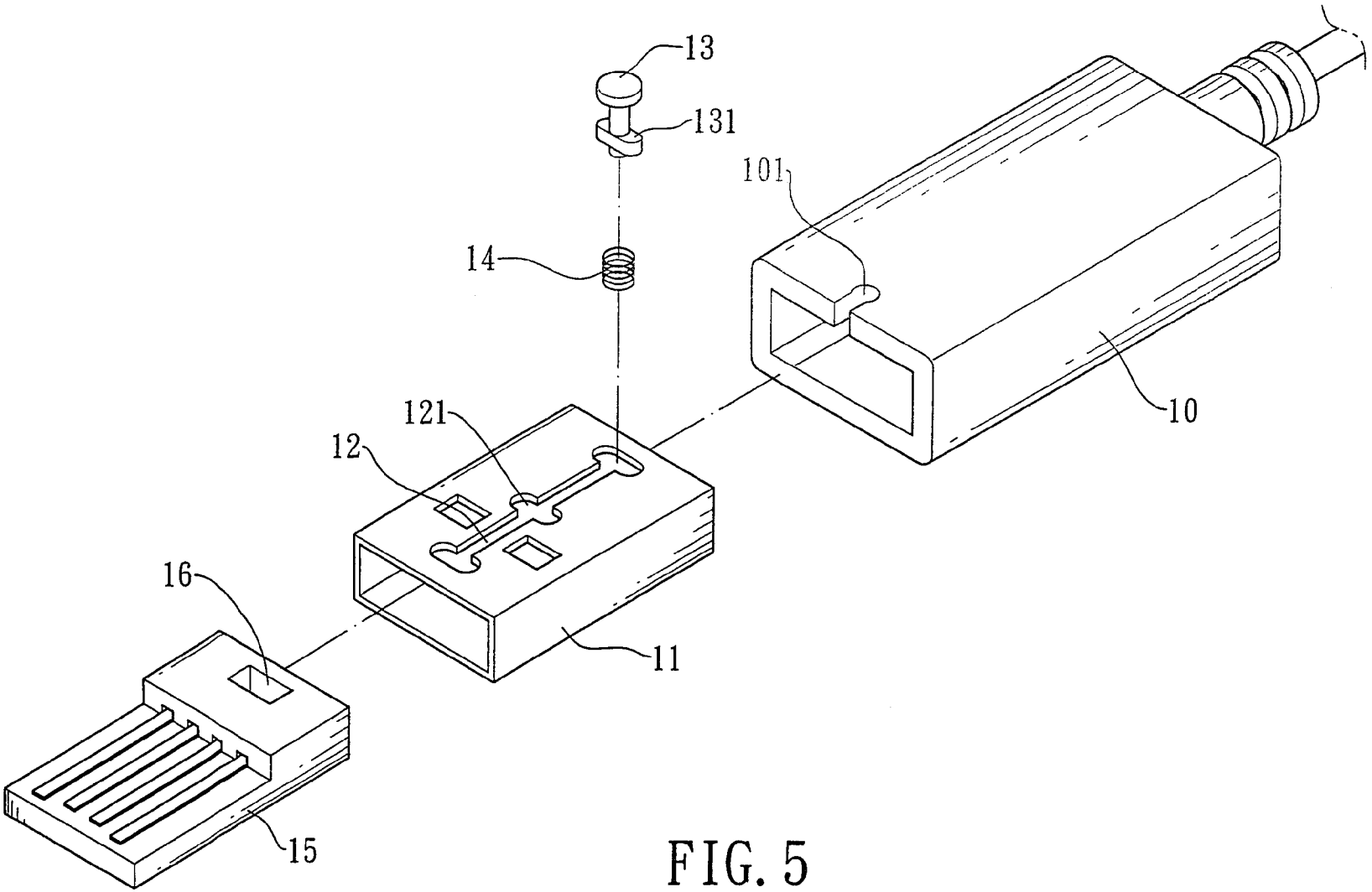
FIG. 5 is an exploded view showing the second preferred embodiment of the present invention.

Referring further to FIG. 4 and FIG. 5, a second preferred embodiment of the present invention is shown. The button 13 is lengthened, and a limit part 131 is mounted on the middle section of the button 13. The spring 14 is mounted in the trench 16 of the terminal block 15, and the terminal block 15 is inserted into the insulating frame 11 so as to align the trench 16 with the limit frame 121 on the track 12. The button 13 is coupled with the spring 14 through the limit frame 121 from outside to inside. The limit part 131 is at the same height as the limit frame 121. The insulating frame 11 is then coupled with the plastic housing 10. Besides, a notch 101 is formed at the open end of the plastic housing 10 so the button 13 is held in the notch 101 and the limit frame 121 in the normal state, as shown in FIG. 6A.

Figure 6B:
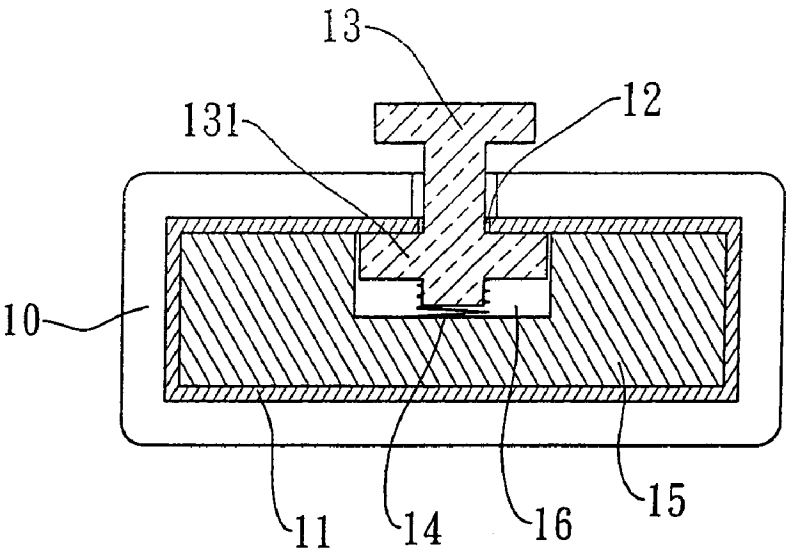
FIG. 6A and FIG. 6B are schematic diagrams taken along line A—A of FIG. 4 for showing the pressing of the button.
Figure 6A:
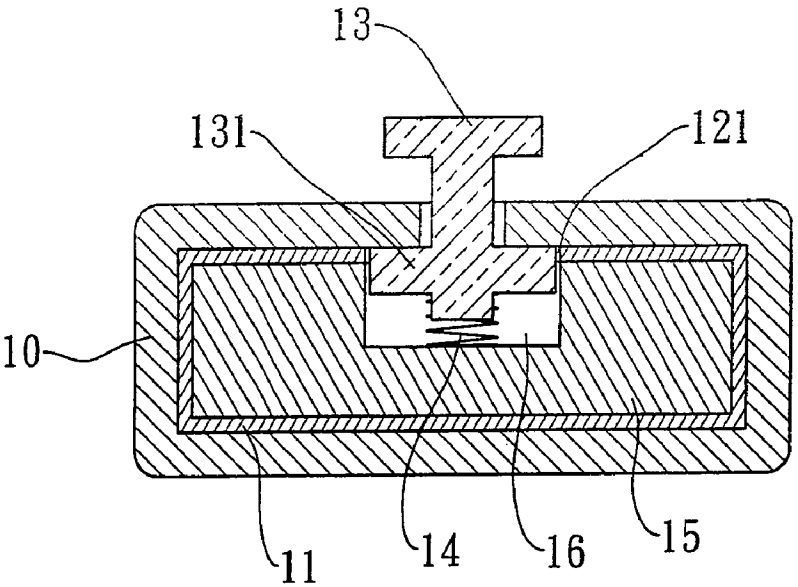

If necessary, the button 13 is pressed down by a downward force, as shown in FIG. 6B, for separating the limit part 131 of the button 13 from the limit frame 121. Accordingly, the button 13 can be shifted to extend the terminal block 15 of the insulating frame 11. As a result, the USB male plug 1 can be elongated.

Figure 7:
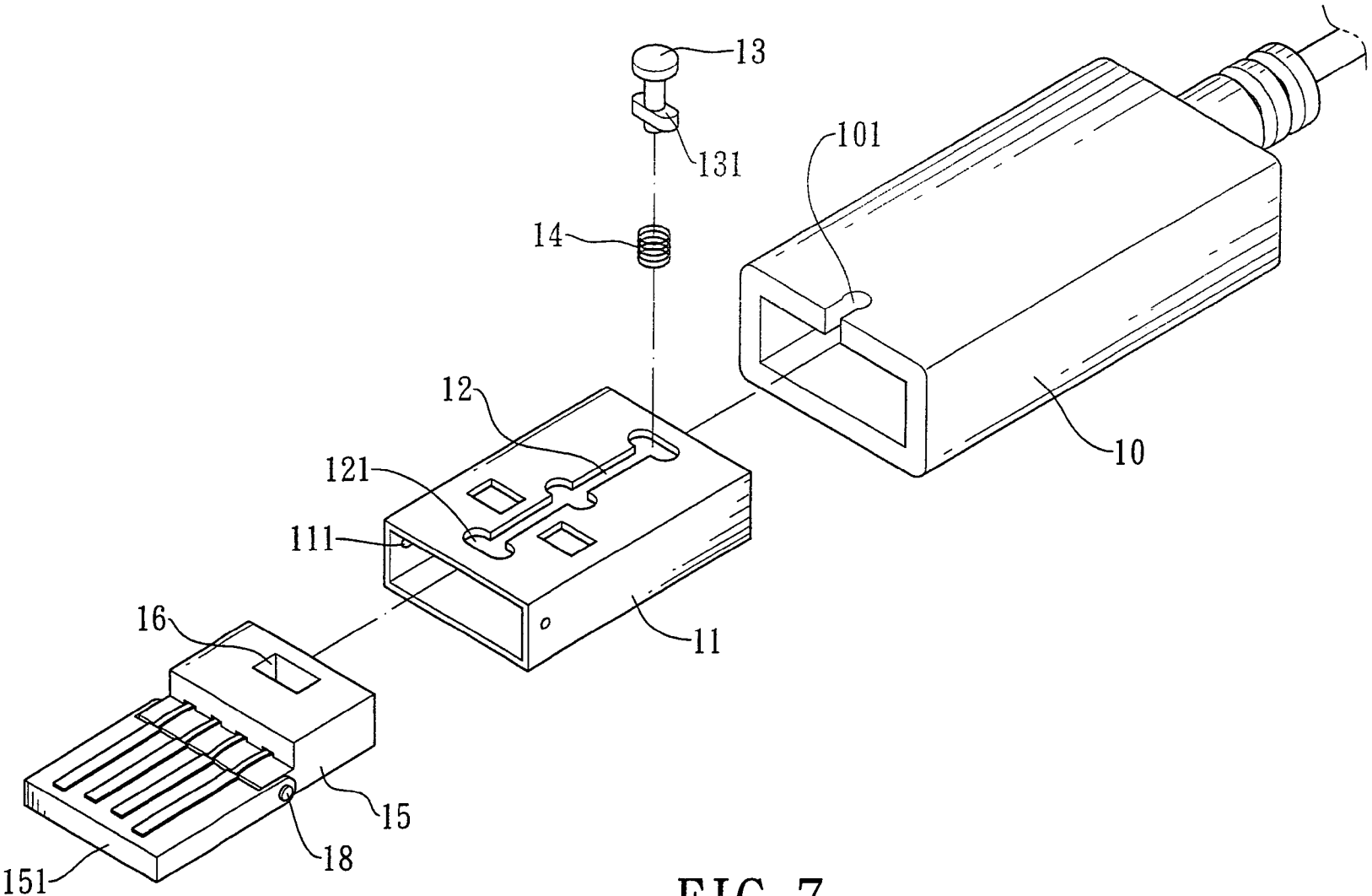
FIG. 7 is an exploded view showing the third preferred embodiment of the present invention.

Referring to FIG. 7, a third preferred embodiment of the present invention is shown, wherein the trench 16 to which the spring 14 is coupled is formed on the rear end of the terminal block 15. Besides, a contact end 151, which is located on the front section of the terminal block 15, is pivotally connected to the terminal block 15 through a pivot 18. The track 12 having several limit frames 121 formed thereon is formed on the top surface of the insulating frame 11, and two protrudent parts 111 are mounted at the front end on two interior lateral surfaces of the insulating frame 11. When the terminal block 15 is inserted into the insulating frame 11, the button 13 is coupled to the spring 14 by penetrating through the limit frame 121 of the track 12 from top to bottom. The insulating frame 11 is then coupled to the plastic housing 10 so as to insert the button 13 into the notch 101. Moreover, the limit part 131 is at the same height as the limit frame 121.

Figure 8:
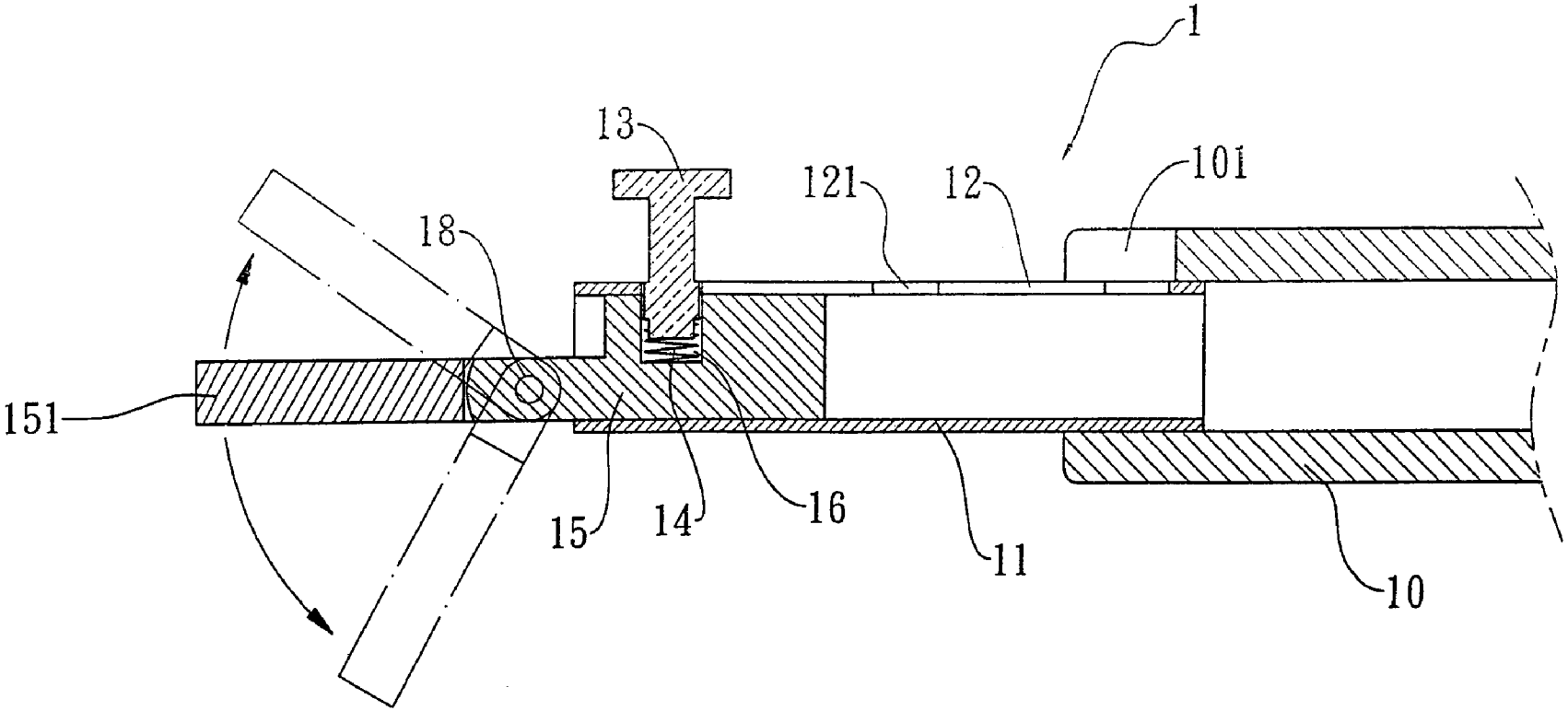
FIG. 8 is a cross-sectional view showing the usage of the third preferred embodiment of the present invention.

Therefore, the contact end 151 of the terminal block 15 will not be shifted until the button 13 is pressed in presence of the protrudent parts 111. If the button 13 is pressed, the limit part 131 will be pressed down to be separated from the limit frame 121. Thus, the button 13 can be shifted and slid forward to shift the terminal block 15 forward, thereby extending the contact end 151 out of the insulating frame 11. Moreover, the contact end 151 can be rotated upward and downward, as shown in FIG. 8. Accordingly, the terminal block 15 of the USB male plug 1 is extendable, and the contact end 151, which is located on the front section of the terminal block 15, can be rotated to adjust the angle. Consequently, several USB male plugs can be inserted into several crowded USB female sockets on the computer, wherein the USB female sockets may not provide sufficient space.

Figure 9:
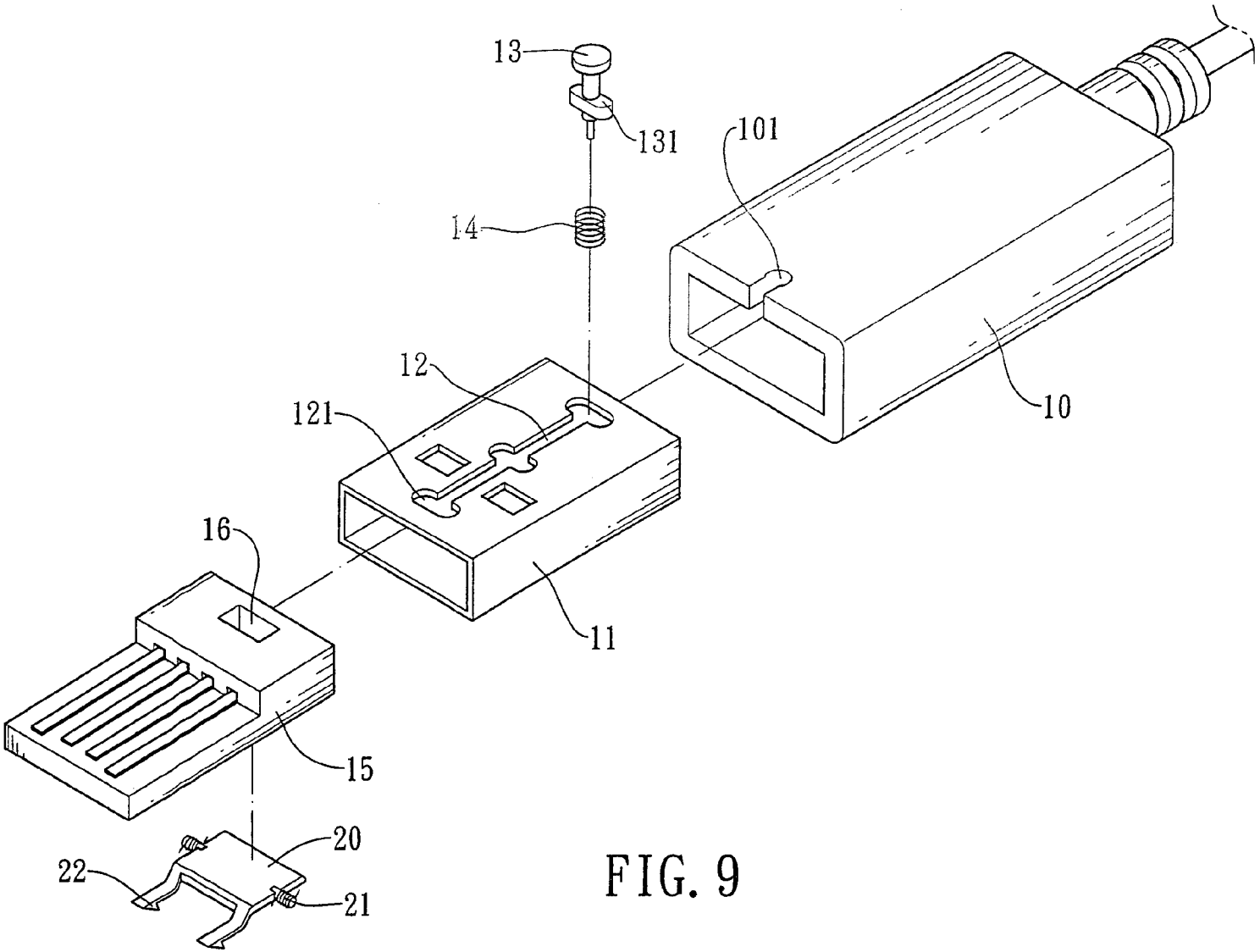
FIG. 9 is an exploded view showing the fourth preferred embodiment of the present invention.
Figure 10:
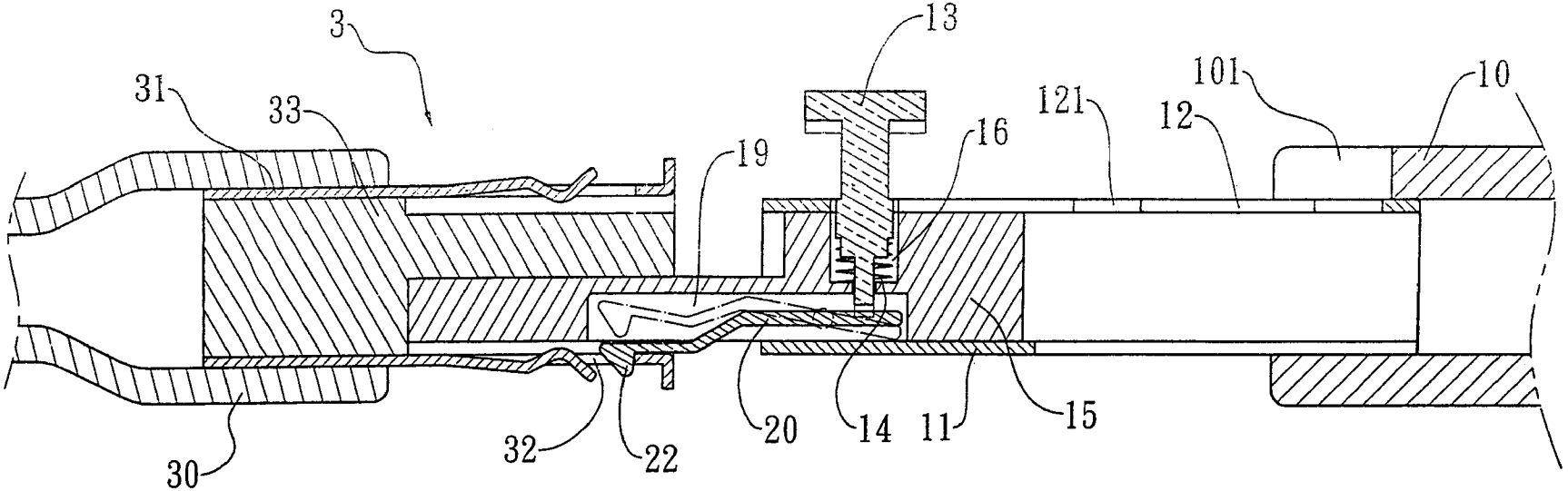
FIG. 10 is a cross-sectional view showing the usage of the fourth preferred embodiment of the present invention.

Referring to FIG. 9 and FIG. 10, a fourth preferred embodiment of the present invention is disclosed. The USB male plug of the present invention is composed of the terminal block 15, the insulating frame 11, and the plastic housing 10, wherein the trench 16 is formed on the back of the terminal block 15 for holding the spring 14. Besides, a trench 9 is formed on the rear bottom of the terminal block 15, wherein the trench 19 is communicated with the trench 16. Moreover, a fastening plate 20 is pivotally mounted in the trench 19, wherein a limit spring 21 is penetrated by a pivot, which is mounted on each side of the fastening plate 20. In addition, the fastening plate 20 comprises two front arms on both front sides. A downward hook part 22 is mounted at the end of each arm. When the terminal block 15 is inserted into the insulating frame 11, the button 13 is coupled to the terminal block 15 and mounted in the trench 16 by penetrating through the limit frame 121 on the track 12 and the spring 14. The limit part 131, which is mounted on the middle section of the button 13, is at the same height as the limit frame 121. Moreover, the bottom of the button 13 is leant against the top surface of the fastening plate 20 through the trench 16, and the button 13 is coupled to the insulating frame 11 through the notch 101, which is formed on the plastic housing 10.

When in use, the limit part 131 is separated from the limit frame 121 by pressing the button 13 such that the rear end of the fastening plate 20 is pressed down and its front end is lifted up, enabling the button 13 and the terminal block 15 to be shifted forward simultaneously. For the purpose of insertion, the contact end, which is mounted on the front section of the terminal block 15, is extended out of the insulating frame 11. Therefore, the hook parts 22 on the bottom of the terminal block 15 are capable of locking the holes 32 on an insulating frame 31 of a USB female socket 3. Due to the locking between the hook parts 22 and the holes 32, the USB male plug and the USB female socket can be prevented from being separated by the careless motion. If it is desired to separate them, the button 13 is pressed again to separate the limit part 131 from the limit frame 121, wherein the rear end of the fastening plate 20 is pressed by the bottom of the button 13 so as to lift up the hook parts 22 and separate the hook parts 22 from the holes 32. Thus, the button 13 can be shifted back to the notch 101 to enable the terminal block 15 to be shrunk back into the insulating frame 11.

Furthermore, it is not necessary to mount the aforementioned components of the present invention on the top of the USB male plug. The aforementioned components comprising the track 12, the button 13, the spring 14, and the trench 16 can be mounted on the both lateral sides or the bottom of the USB male plug. In addition, the positions of other related components are thus altered correspondingly.

From the above-mentioned description, it is apparent that the structure of the present invention provides the following advantages in which:

1. The structure of the USB male plug is simple, and the terminal block can be extended or elongated so as to overcome the shortcoming caused by the deeply mounted USB female socket.

2. The terminal block is pivotally connected to the upward and downward rotatable contact end, which is extendable to the outside of the insulating frame, for overcoming the problems caused by the closely mounted USB female sockets, which are unable to provide sufficient space.

3. When coupled, the hook parts of the fastening plate of the USB male plug lock the holes of the USB female socket so as to enhance the connection stability. Accordingly, the occurrence of separation caused by careless pull is prevented.

On the basis of the aforementioned description, the present invention satisfies all requirements for a patent and is therefore submitted for a patent.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What the invention claimed is:

1. An extendable USB male plug including a plastic housing, an insulating frame, and a terminal block, said male plug comprising:

a button mounted on the the plastic housing and the insulating frame for controlling the terminal block such that the terminal block is outwardly extendable by pressing and shifting the button;

a track having at least two limit frames formed on a surface of the insulating frame;

a first trench, inside which a spring is mounted, is formed on the terminal block corresponding to the track, wherein the button is coupled with the spring by penetrating through the track on the insulating frame; and a limit part having a shape corresponding to that of the limit frames mounted on a middle section of the button, and wherein the button mounted on the spring is higher than the plastic housing.

2. The extendable USB male plug of the claim 1, further comprising a notch formed on the plastic housing for mounting the button.

3. The extendable USB male plug of the claim 1, further comprising a contact end connected to the terminal block through a pivot such that the contact end is upward and downward rotatable.

4. The extendable USB male plug of the claim 1, further comprising two protrudent parts mounted at a front end on two interior lateral surfaces of the insulating frame.

* * * * *